US005984812A

United States Patent [19]

Sassak

[11] Patent Number: 5,984,812

[45] **Date of Patent: *Nov. 16, 1999**

[54] GRIPPABLE SURFACE FOR THROWABLE OBJECT

[76] Inventor: Mark S. Sassak, 1340 Linden St., Plymouth, Mich. 48170

[ * ] Notice: This patent is subject to a terminal disclaimer.

[21] Appl. No.: 09/188,651

[22] Filed: Nov. 9, 1998

Related U.S. Application Data

[63] Continuation of application No. 08/893,076, Jul. 15, 1997, Pat. No. 5,851,161.

[51] Int. Cl.[6] ..... A63B 43/00; A63B 59/00

[52] U.S. Cl. ..... 473/596; 473/568; 442/149; 442/150

[58] Field of Search ..... 473/569, 596, 473/597, 573, 574, 575, 576, 612, 568, 300, 301, 302, 303, 549; 442/1, 2, 50, 58, 149, 150

[56] References Cited

U.S. PATENT DOCUMENTS

| | | | |
|---|---|---|---|
| 2,257,252 | 9/1941 | Vorbusch | 473/596 |
| 2,270,553 | 1/1942 | Potito | 473/596 |
| 2,468,202 | 4/1949 | Karns | 473/300 |
| 2,931,653 | 4/1960 | Gow et al. | 473/596 |
| 2,984,486 | 5/1961 | Jones | 473/568 |
| 3,067,085 | 12/1962 | Limperos | 442/149 |
| 4,347,280 | 8/1982 | Lau et al. | 473/596 |
| 5,294,115 | 3/1994 | Phillips et al. . | |
| 5,491,015 | 2/1996 | Reeves et al. | 473/568 |
| 5,707,903 | 1/1998 | Schottenfeld | 442/58 |
| 5,851,161 | 12/1998 | Sassak | 473/596 |

*Primary Examiner*—Steven Wong
*Attorney, Agent, or Firm*—Harness, Dickey & Pierce, PLC

[57] ABSTRACT

A mesh panel for throwable and/or grippable objects such as footballs, baseballs, basketballs, baseball bats, etc. The mesh panel is formed from polyvinylchloride (PVC) and includes a plurality of openings surrounded by a plurality of connecting portions. The outer surface of the mesh panel is such that each of the connecting portions includes a plurality of rib portions which further enhance the ability to grip the mesh panel. The inside surface of the mesh panel has an adhesive coating which bonds to an outer surface of the object to which the mesh panel is attached when heat is applied to the mesh panel. The heating of the mesh panel also causes a sticky, resin-like outer surface to be formed. The mesh panel enables various objects such as footballs, baseballs, basketballs, baseball bats, etc. to be much more easily grasped, thrown and caught by individuals of all ages and sizes, and particularly by individuals such as small adults and children having relatively small hands. The mesh panel is durable, does not add appreciable weight to the object to which it is attached or otherwise significantly affect the aerodynamics or trajectory of throwable objects to which the mesh panel is attached.

19 Claims, 2 Drawing Sheets

FIG 1
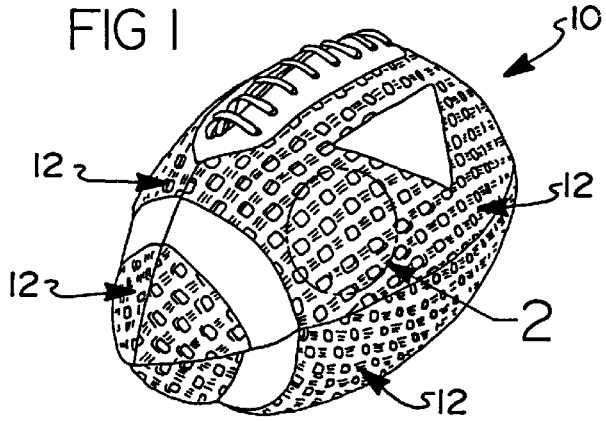
FIG 2
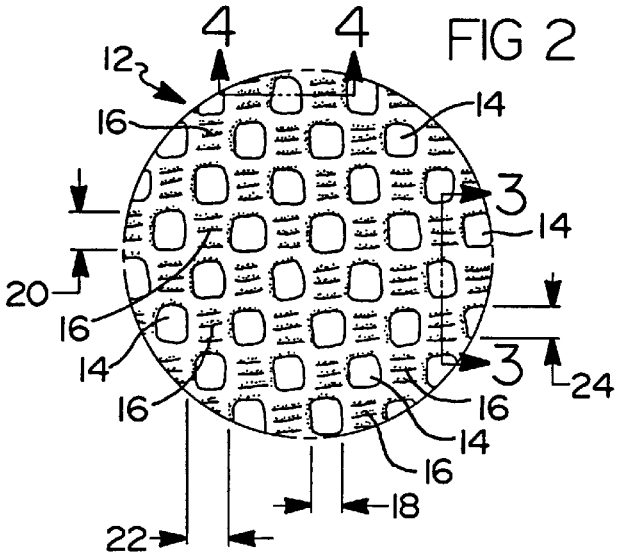
FIG 3
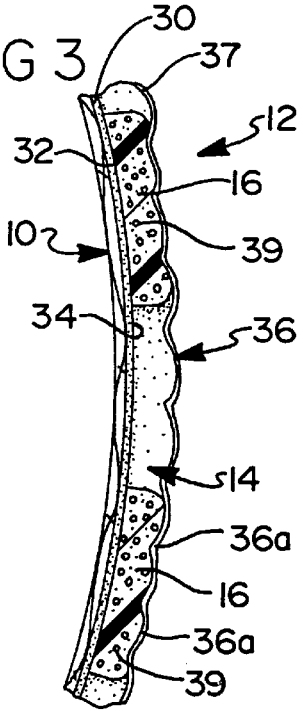
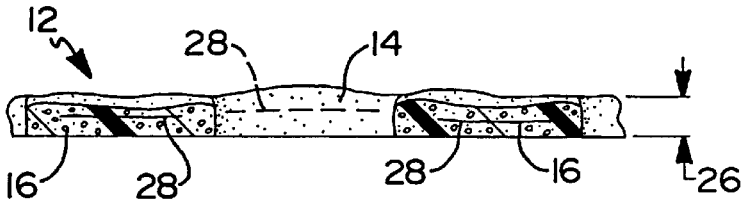
FIG 4

GRIPPABLE SURFACE FOR THROWABLE OBJECT

This is a continuation of U.S. patent application Ser. No. 08/893,076, filed Jul. 15, 1998 now U.S. Pat. No. 5,851,161.

CROSS-REFERENCE TO RELATED APPLICATIONS

This application is related to U.S. design application Ser. No. 29/073,272, filed Jul. 15, 1997, and assigned to the assignee of the present application, attorney docket no. 7161-000018, entitled "Surface For A Throwable Object" filed concurrently herewith.

BACKGROUND OF THE INVENTION

1. Technical Field

This invention relates to a grippable surface for throwable objects such as a football, baseball, etc. which enhances the ease with which the object may be grasped and thrown, especially by young individuals having relatively small hands.

2. Discussion

Objects such as footballs, baseballs, basketballs, etc. are used in a wide variety of recreational activities by both adults and children. When used by children or small adults, such throwable objects often are not easily grasped if the adult's or child's hands are relatively small. Often, such objects are also difficult to catch for individuals having small hands, and even for individuals having relatively large hands due to the relatively slippery or smooth outer surfaces of many throwable objects. Attempts to remedy this problem have involved making the throwable objects considerably smaller in dimensions in an effort to make same more easily graspable. However, making footballs, basketballs, baseballs and other like objects smaller can also serve to make such objects more difficult to throw properly.

It is therefore a principal object of the present invention to provide a grippable surface which may be applied to a wide variety of throwable objects such as footballs, basketballs, baseballs, and also to other objects such as baseball bat handles, etc., which make it easier for a child or adult to grasp the object when throwing or handling it.

It is still another object of the present invention to provide a grippable surface for a throwable object such as a football, basketball, baseball, etc., which can be applied to the object quickly and easily, and relatively inexpensively, without adding appreciably to the overall cost, outer dimensions or weight of the object.

It is still another object of the present invention to provide a grippable surface which is durable and light in weight so as not to otherwise hinder throwing of the object by young children.

SUMMARY OF THE INVENTION

The above and other objects are provided by a grippable surface in accordance with preferred embodiments of the present invention. The grippable surface generally comprises one or more mesh panels which may be secured to an outer surface of a throwable object such as a football, basketball, baseball, etc. at one or more strategic places on the object, to enhance the ease with which one may grasp and throw the object. The mesh panel is generally comprised of a polyvinylchloride (PVC) closed cell, air-pocketed material which is embedded with a nylon webbing. The mesh panel includes a plurality of generally square-shaped openings each surrounded by a plurality of generally square-shaped connecting portions. The connecting portions are slightly larger in overall dimensions than the openings. The mesh panel has an outer surface and each one of the connecting portions has a plurality of ribs formed on the outer surface which further facilitate gripping of the mesh panel, and therefore the throwable object to which the mesh panel is attached.

The mesh panel includes an inner surface having an adhesive layer applied thereon which is activated when heat is applied to it. The adhesive layer secures the mesh panel to an outer surface of the throwable object when heat is applied to the mesh panel while it is placed against a portion of the throwable object. In the preferred embodiments, the openings of the mesh panel may vary considerably in size, but in one preferred embodiment each opening has a width of between about 0.125 inch and 0.500 inch and a height between about 0.125 inch and 0.500 inch.

The mesh panel is relatively inexpensive to construct and attach to objects such as footballs, basketballs, baseballs, etc., and further does not add appreciably to the overall weight of the object. In this manner the ease with which individuals can grasp, throw and catch various objects having the mesh panel of the present invention is considerably enhanced. The mesh panel is further durable and does not appreciably affect the aerodynamics of the object to which it is attached.

BRIEF DESCRIPTION OF THE DRAWINGS

The various advantages of the present invention will become apparent to one skilled in the art by reading the following specification and subjoined claims and by referencing the following drawings in which:

FIG. 1 is a perspective view of a football having a plurality of sections of the mesh panel of the present invention secured thereto;

FIG. 2 is an enlarged area of the football denoted by circle 2 in FIG. 1 illustrating the upper surface of the mesh panel in greater detail;

FIG. 3 is a cross sectional view of a portion of the mesh panel shown in FIG. 2 in accordance with section line 3—3 in FIG. 2;

FIG. 4 is a cross sectional view of a portion of the mesh panel in accordance with section line 4—4 in FIG. 2;

DETAILED DESCRIPTION OF THE PREFERRED EMBODIMENTS

Figure 5:
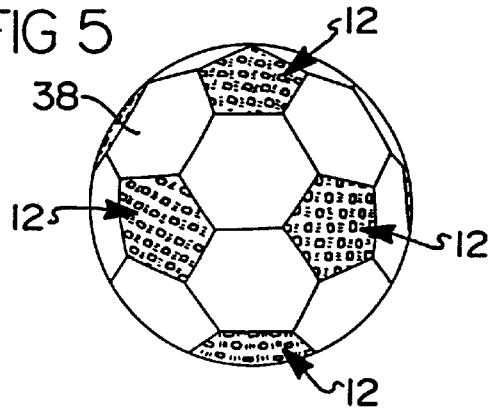
FIG. 5 is a perspective view of a soccer ball incorporating a plurality of sections of the mesh panel.

Referring to FIG. 1, there is shown a football 10 having a plurality of mesh panels 12 thereon in accordance with a preferred embodiment of the present invention. The mesh panels 12 form a grippable surface which enhances the ease with which the football 10 may be grasped, thrown and caught, especially by individuals having relatively small hands. It will be appreciated immediately, however, that the mesh panels 12 are not limited to footballs, but may be applied to many different forms of objects to enhance the ease with which an object may be grasped, thrown and/or caught.

Referring to FIG. 2, a small section of the mesh panel 12 is shown. The mesh panel 12 comprises a plurality of openings 14 which are each surrounded by a plurality of generally square shaped areas 16. Each of the openings 14 has a width, defined by arrows 18, of preferably between about 0.125 inch–0.500 inch, and more preferably about 0.25 inch. Each opening 14 further has a height, as indicated by arrows 20, of also between about 0.125 inch–0.500 inch. It will be appreciated that the openings could be formed smaller or larger without departing from the scope of the claims hereof, but that it is anticipated that the just-given preferred dimensions are those that noticeably enhance the ease with which the mesh panel 12 may be grasped.

With further reference to FIG. 12, each of the connecting portions 16 is used to separate four circumferentially spaced openings. Each connecting portion 16 has a width, as defined by arrows 22, of preferably about 0.125 inch, and more preferably at least about 0.250 inch. Each connecting portion 16 further has a height, as defined by arrows 24, of also preferably at least about 0.125 inch, and more preferably at least about 0.250 inch. With brief reference to FIG. 4, the overall thickness of the mesh panel 12, as indicated by arrows 26, is preferably at least about 0.0625 inch and more preferably between about 0.0625 inch–0.125 inch. The mesh panel 12 is preferably made from closed cell, air-pocketed material polyvinylchloride (PVC) and includes a nylon webbing material 28 embedded therein for added strength. The mesh panel 12 is formed preferably by well known injection molding techniques to produce its closed cell, air-pocketed structure in sizes which may be cut to smaller sections and used as needed for variously shaped throwable objects.

Referring to FIG. 3, the mesh panel 12 includes an adhesive layer 30 which is supplied to a lower surface 32 of the mesh panel 12. The adhesive layer 30 bonds the mesh panel 12 to an outer surface 34 of a base panel of the throwable object 10 when heat is applied to the mesh panel 12. During the heating process the outer surface 36 of the PVC material also develops and thereafter maintains a sticky resin-like outer surface layer 37 which also facilitates grasping, throwing and catching of objects to which it is bonded. The mesh panel, being made from PVC, has a plurality of closed cell air pockets 39 formed therein which also helps to cushion the impact when objects are caught. Preferably, one or more sections of the mesh panel 12 are bonded to one or more similarly shaped base panel sections of the throwable object, and the panel sections then secured together such as by sewing to form the throwable object 10. The adhesive 30 may be any commercially available adhesive which is activated upon the application of heat.

With further reference to FIG. 3, it will be appreciated that an outer surface 36 of the mesh panel 12 is formed to include a plurality of ribs 36*a* which further enhance the ease with which the mesh panel 12 may be grasped. The mesh panel 12 is preferably secured to the panels which will make up the throwable object 10 in a manner which orientates the ribs 36*a* such that the ribs 36*a* extend generally perpendicular to the direction in which the fingers of a hand extend when the object is grasped. It will be appreciated immediately, however, that the mesh panel 12 could be secured in any orientation to a throwable object and will appreciably increase the ease with which the object may be grasped. Orientating mesh panel 12 in the just-described manner, however, enables the ribs 36*a* to further help function as a gripping surface.

The mesh panel 12 of the present invention is relatively light in weight and does not noticeably affect the aerodynamic properties of the object to which it is attached. Thus, mesh panel 12 does not make the football 10 feel noticeably heavier or otherwise noticeably affect its performance or trajectory when the football 10 is thrown. The mesh panel 12 is further relatively durable and provides somewhat of a rubber-like feel which helps significantly to allow individuals having small hands to grasp the football 10 and throw and catch same with significantly increased ease.

Figure 6:
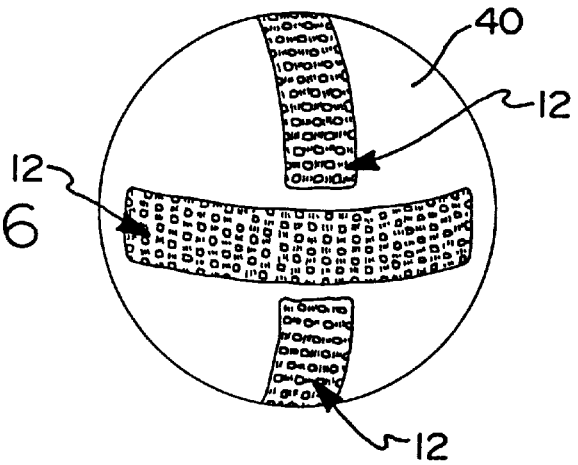
FIG. 6 is a volleyball incorporating a plurality of sections of the mesh panel.
Figure 7:
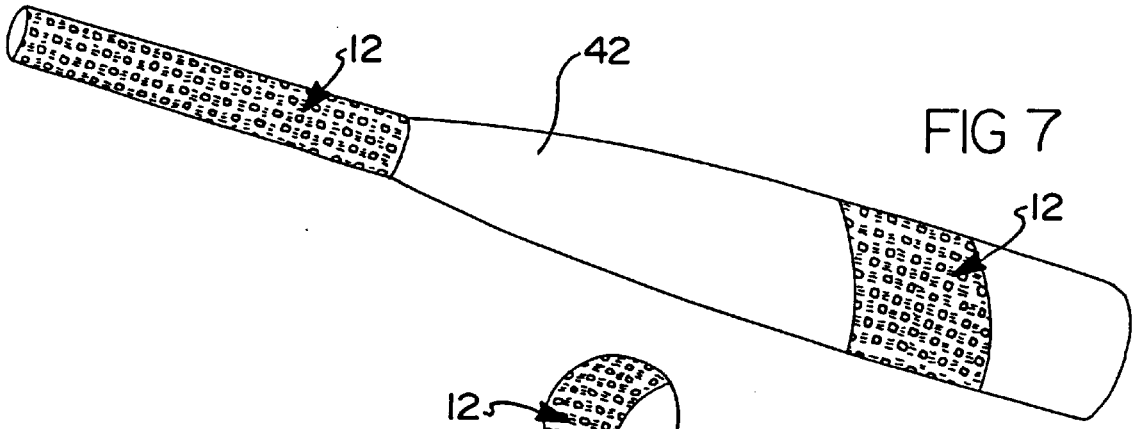
FIG. 7 is a perspective view of a baseball bat incorporating a plurality of sections of the mesh panel.
Figure 8:
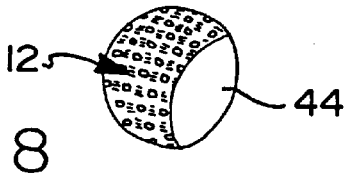
FIG. 8 is a perspective view of a baseball incorporating the mesh panel of the present invention.

Referring to FIG. 5, a plurality of mesh panel sections 12 are illustrated attached to a soccer ball 38. In FIG. 6, a plurality of sections of the mesh panel 12 are illustrated attached to a volleyball 40. In FIG. 7, a plurality of the panel sections 12 are illustrated attached to a baseball bat 42. FIG. 8 shows a panel section 12 attached to a baseball 44.

From the above, it will be appreciated that the mesh panel 12 of the present invention is easily and readily attachable to a wide variety of objects to significantly increase the ease with which such objects may be grasped, thrown and/or caught, especially by young children and adults having relatively small hands. With such individuals, it is often quite difficult to grasp and throw objects such as standard sized footballs, basketballs, baseballs, etc. The mesh panel 12 of the present invention therefore significantly eases the manner in which such objects can be thrown by such persons.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A recreational object having a grippable surface attached thereto to facilitate grasping of said object; said recreational object comprising:

a mesh panel having an inner surface, an outer surface, a plurality of openings and a plurality of connecting portions adjacent each one of said openings;

said inner surface of said mesh panel including an adhesive layer adapted to be secured to an outer surface of said recreational object upon the application of heat to said mesh panel for a minimum predetermined time period while said mesh panel is in contact with said outer surface of said recreational object;

said mesh panel being formed from a material having a tacky surface to facilitate gripping thereof; and said connecting portions each having a plurality of raised portions formed thereon which generally circumscribe said openings to further enhance gripping of said recreational object.

2. The recreational object of claim 1, wherein each one of said openings comprises a generally square-shaped opening; and wherein each one of said connecting portions is comprised of a generally square-shaped portion.

3. The recreational object of claim 1, wherein each of said opening comprises a width of at least about 0.125 inch.

4. The recreational object of claim 1, wherein each of said openings comprises a height of at least about 0.125 inch.

5. The recreational object of claim 1, wherein said tacky surface of said mesh panel comprises a sticky, resin-like outer surface.

6. The recreational object of claim 1, wherein said mesh panel comprises a plurality of closed cell air pockets to cushion the impact to hands of an individual when said object is caught after being thrown.

7. The recreational object of claim 6, wherein said mesh panel further comprises a nylon webbing material embedded therein.

8. The recreational object of claim 7, wherein said mesh panel comprises polyvinylchloride (PVC).

9. The recreational object of claim 2, wherein said generally square-shaped opening has a width of about 0.125–0.500 inch, a height of between about 0.125 inch–0.500 inch; and wherein said connecting portions each have a width of between about 0.125 inch–0.500 inch and height of between about 0.125 inch–0.500 inch.

10. The recreational object of claim 1, wherein the height and width of each opening are each approximately 0.25 inch; and wherein the height and width of each connecting portion are each approximately 0.25 inch.

11. The recreational object of claim 1, wherein said mesh panel has a thickness of at least about 0.0625 inch.

12. The recreational object of claim 1, wherein said mesh panel has an undulating outer surface.

13. The recreational object of claim 1, wherein said mesh panel comprises polyvinylchloride (PVC) having a plurality of closed cell air pockets embedded therein, and a sticky, resin-like, undulating outer surface.

14. A recreational object having a grippable surface to enhance the ease with which said object may be grasped, said recreational object comprising:

at least one mesh panel adapted to be secured to said recreational object;

said mesh panel having a plurality of generally square-shaped openings, each one of said generally square-shaped openings having a plurality of generally square-shaped connecting portions adjacent thereto;

said mesh panel having an inner surface and an outer surface, said inner surface having a layer of adhesive thereon and adapted to bond to an outer surface of said recreational object when heat is applied to said mesh panel;

said generally square-shaped connecting portions of said mesh panel each having a plurality of ribs for further facilitating gripping thereon; and said mesh panel comprising a closed cell, air-pocketed material having nylon material embedded therein.

15. The recreational object of claim 14, wherein each of said generally square-shaped openings has a width of at least about 0.125 inch; and wherein each one of said connecting portions has a width of at least about 0.25 inch and a height of at least about 0.25 inch.

16. The recreational object of claim 14, wherein said mesh panel is secured to said recreational object such that said panel is secured with said ribs extending generally perpendicular to the direction in which the fingers of a hand gripping said object extend when grasping said object.

17. The recreational object of claim 14, wherein said mesh panel has a thickness of at least about 0.0625 inch.

18. A recreational object adapted to be grasped by an individual, said recreational object comprising:

at least one base panel;

at least one mesh panel adapted to be secured to said throwable object;

said mesh panel having a plurality of openings, each one of said openings having a plurality of connecting portions adjacent thereto;

each of said connecting portions having a plurality of raised ribs and generally circumscribing said openings, each of said ribs being formed generally parallel to one another and extending in a direction generally perpendicular to the direction in which the fingers of a hand of said individual extend over said recreational object when grasping said object;

said mesh panel having an inner surface and an outer surface, said inner surface having a layer of adhesive thereon and adapted to bond to an outer surface of said base panel when heat is applied to said mesh panel;

said mesh panel being formed from a closed cell, air-pocketed material having nylon material embedded therein; and wherein said outer surface of said mesh panel assumes a sticky, resin-like texture after said heat is applied to said mesh panel.

19. The recreational object of claim 18, wherein said mesh panel is comprised of polyvinylchloride (PVC).

* * * * *